US007364379B2

(12) United States Patent
Cetera

(10) Patent No.: US 7,364,379 B2
(45) **Date of Patent: *Apr. 29, 2008**

(54) IMPLEMENT GRIP

(75) Inventor: Carl Cetera, Tenafly, NJ (US)

(73) Assignee: Cotapaxi Custom Design and Manufacturing, LLC, Carlstadt, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/562,907

(22) Filed: Nov. 22, 2006

(65) Prior Publication Data

US 2007/0110496 A1 May 17, 2007

Related U.S. Application Data

(63) Continuation-in-part of application No. 11/126,537, filed on May 10, 2005, now Pat. No. 7,156,570.

(60) Provisional application No. 60/640,762, filed on Dec. 30, 2004.

(51) Int. Cl.
*A46B 5/02* (2006.01)

(52) U.S. Cl. ..... 401/6; 16/430

(58) Field of Classification Search ..... 401/6, 401/195; 74/551.9; 16/430, 436; D19/47, D19/51; D8/303, 305
See application file for complete search history.

(56) References Cited

U.S. PATENT DOCUMENTS

| | | | | |
|---|---|---|---|---|
| 4,951,533 | A * | 8/1990 | Hillinger | 81/177.1 |
| 5,579,668 | A * | 12/1996 | Kozak | 81/439 |
| 5,738,401 | A * | 4/1998 | Fan | 294/171 |
| 6,702,499 | B1 * | 3/2004 | Fang | 401/243 |
| 7,156,570 | B2 | 1/2007 | Cetera | |

* cited by examiner

*Primary Examiner*—David J Walczak
(74) *Attorney, Agent, or Firm*—The Soni Law Firm

(57) ABSTRACT

An implement grip having a generally tapered cylindrical shape and being integrally formed with or removably fitted over a handheld implement. The grip comprises a base layer cushioned and textured for increased user comfort, and a plurality of rings formed on the surface thereof, each having a raised circumference and a central depression, for enhanced attachment and better gripping of the implement. Advertising material may be disposed upon an outer surface of the handheld implement or the grip.

15 Claims, 2 Drawing Sheets

IMPLEMENT GRIP

CROSS REFERENCE TO RELATED APPLICATIONS

This application is a continuation-in-part of application Ser. No. 11/126,537, filed on May 10, 2005, which claims the benefit of U.S. Provisional Application No. 60/640,762, filed on Dec. 30, 2004. The application Ser. No. 11/126,537 matured into U.S. Pat. No. 7,156,570. All of the prior Applications and Patent identified above are hereby incorporated by reference.

BACKGROUND OF THE INVENTION

The present invention relates to a grip applied to various handheld devices. More specifically, the present invention relates to a textured grip which would typically be used with a writing implement. The textured grip of the present invention has a pattern comprising small suction cups on an outer surface thereof.

Grips are added to handheld devices to allow them to be held more securely and to provide a cushioning effect. The grip may be provided as an accessory to be added to a handheld implement or may be an integral part of a device. Grips made of leather, foam, rubber, and various synthetic materials are well known. Frequently, textures are added to a grip to increase the ability of a hand to hold on to the handheld device. These grips may be placed on sporting equipment such as tennis racquets or golf clubs. Other grips are placed on electronic devices such as calculators. Grips are also commonly placed on some writing implements to improve comfort during use or to aid in more securely holding the writing implement.

Various types of enhanced grips are described in the prior art. In U.S. Pat. No. 6,203,225, Baudino describes a grip with cushioning effect consisting of a plurality of ribs extending parallel to one another and in a plane perpendicular to the implement's longitudinal axis. A raised textured grip composed of a hexagonal pattern for a writing implement in described in U.S. Pat. No. 6,379,065 to Perry. Other grip enhancement devices are described in U.S. Pat. Nos. 4,932,800 to Lin (compressible gripping device); U.S. Pat. No. 5,143,463 to Pozil (triangular shaped contoured pad); U.S. Pat. No. 5,468,083 to Chesar (triangular attachment); and U.S. Pat. No. 5,558,452 to Oka (coaxial rings around implement). None of these devices, however, provides an enhanced gripping action with a suctioning means and none combine the enhanced gripping with an ergonomic cushioned surface.

While many grip enhancers are known in the art, there remains a need for a grip that is ergonomic, while providing a cushioning effect and improved gripping characteristics.

SUMMARY OF THE INVENTION

One of the advantages of the present invention is to provide a comfortable ergonomic grip for a handheld implement that is compressible and resilient to provide a cushioning effect. Another advantage of the grip made according to the present invention is to provide an interesting and attractive texture upon a grip for a handheld implement. Still another advantage of the grip made according to the present invention is to enhance the attachment of a handheld implement to a users hand for better grasping of the handheld implement.

The advantages of the present invention listed above are accomplished by providing a compressible textured grip having a pattern of small suction cups formed thereon. Although suction cups are well known as a means of attachment of a device to a surface, they have never been used as a grip enhancer for a handheld writing implements. Furthermore, the grip in the present invention is capable of being incorporated into any other kind of handheld devices in which the small suction cups would facilitate securer grasping of those devices. The grip having such suction cups is not only functional but is also interesting and attractive in appearance.

More particularly, the grip made according to the present invention, which is for a handheld writing implement in the preferred embodiment, comprises a base layer which has an elongated generally cylindrical configuration that is tapered such that one of its two opposing generally circular ends has a generally larger circumferential diameter than the other. The base layer is sized according to the size of the body of the writing implement, as well as of a user's fingers. The base layer is fabricated of cushioned compressible material and textured to provide an interesting and attractive texture when gripping the grip. Further, the base layer has a plurality of rings formed upon an outer surface thereof, each of which has a generally round elevated circumference and a central depression to create suction effects for enhancing attachment thereto. Such rings may be arranged following some geometric pattern, or randomly.

BRIEF DESCRIPTION OF THE DRAWINGS

The foregoing objects, features, advantages and preferred embodiments of the evacuation unit and method of the present invention will be better understood from the following detailed description taken in conjunction with the accompanying drawings in which.

DETAILED DESCRIPTION OF THE INVENTION

Figure 1:
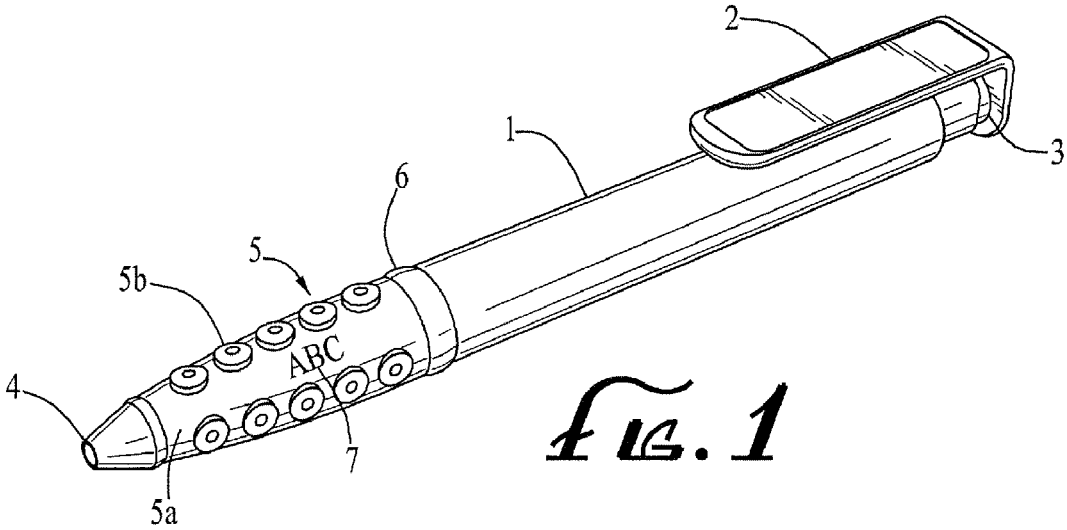
FIG. 1 illustrates a perspective view of the preferred embodiment of this invention showing the grip of the present invention incorporated into a handheld writing implement.

In the accompanying Figures, only the preferred embodiment of the invention is shown and described simply by way of illustration of the best mode contemplated of carrying out the invention. As will be realized, the invention is capable of other and different embodiments that are readily apparent to those skilled in the art, and its several details are capable of modifications in various obvious respects, all without departing from the invention. Accordingly, the drawing and description are to be regarded as illustrative in nature, and not as restrictive.

With regard to means for fastening, mounting, attaching or connecting the components of the present invention to form the apparatus as a whole, unless specifically described otherwise, such means are intended to at least encompass conventional fasteners such as machine screws, machine threads, snap rings, hose clamps such as screw clamps and the like, rivets, nuts and bolts, toggles, pins and the like. Components may also be connected by friction fitting, snap fitting, adhesives, or by welding or deformation, if appropriate. Unless specifically otherwise disclosed or taught, materials for making components of the present invention are selected from appropriate materials such as metal, metallic alloys, natural or synthetic fibers, plastics and the like, and appropriate manufacturing or production methods including casting, extruding, injection molding and machining may be used.

Referring more specifically to the drawings, FIGS. 1-5 show a preferred embodiment of the grip of the present invention integrated into a handheld writing implement. The handheld writing implement in the preferred embodiment is a pen. The writing implement comprises a body 1 having a first and an opposed second body ends, a clip 2 attached to the first body end, an actuator 3 connected to the body 1, and preferably, to the clip 2 as well at the first body end, an extendable tip 4 located at the second body end, and a compressible textured grip 5 retained over the body 1 proximate the second body end. Preferably, the writing implement has a shape of a typical straight cylinder up to approximately two thirds of its body 1 starting from the first body end, and from then on, is smoothly narrowed down while maintaining the overall cylindrical shape as it nears the second body end, thereby defining a generally tapered cylindrical section. The compressible textured grip 5 is sleeved over this generally tapered cylindrical section of the implement, and accordingly, has a generally elongated tapered cylindrical shape having two opposing circular ends, where one end has a generally larger circumferential diameter than the other. The grip 5 is preferably detachably and frictionally fitted over the tapered section, but may be fixedly incorporated on it by means of adhesives or other permanent attachment means known in the art. A ring like member 6 demarcates the grip 5 from the superior straight cylindrical part of the pen. Pressing the actuator 3 causes a ball point ink containing member to protrude or retract from the tip 4. Inside the pen is a typical ball point pen mechanism. The internal mechanisms of a ball point pen are well known in the art and will not be described further herein.

Figure 5:
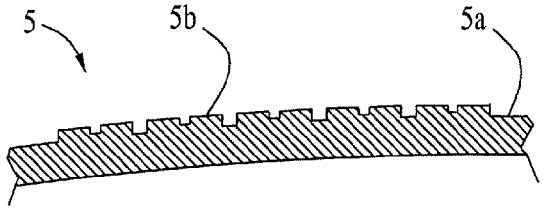
FIG. 5 is a side cross sectional view of the grip for a handheld implement in the preferred embodiment of the present invention.

The grip 5 comprises of a base layer 5*a* which is fabricated of, preferably, various resilient and deformable materials to provide a cushioning effect when gripped by fingers of a user. Such materials are well known in the art, including but not limited to, foam, leather, elastomeric materials such as rubber, synthetic rubbers such as polyurethane, silicone, or plastics. Various thermoplasic elastomers commonly used for such devices are well known in the art. Although such a grip in the present invention is depicted as being fitted on a handheld writing implement in the preferred embodiment, it may be manufactured as a separate sleeve and then be applied on any other kind of handheld devices that have a generally elongated tapered cylindrical section The base layer 5*a* is, preferably, textured as well to provide an interesting and attractive texture upon a grip for a handheld implement. Further, the textured base layer 5*a* comprises a plurality of elevated circular rings 5*b* integrally formed on an outer surface thereof. As shown in more detail in FIGS. 1-5, each of the plurality of rings 5*b* has an elevated circumference and a central depression to resemble a suction cup. This particular configuration provides a slight suction effect against the fingers of a user of the implement. The suction would enhance attachment of the fingers to the grip, and thus, facilitate the grasping of the handheld implement. The elevation of each ring also provides additional traction during use. The base layer 5*a* itself may be smooth or have a slightly elevated or raised pattern. FIG. 5 shows a side cross sectional view of the grip 5 of the preferred embodiment, sectioned along the line 5-5 of FIG. 3, in which the textured base layer 5*a* and the rings 5*b* are described as being integrally formed.

The plurality of rings 5*b* may be arranged on the textured base layer 5*a* of the grip 5 in various geometric patterns. As shown in the preferred embodiment of FIGS. 1-4, they may be arranged concentrically about a longitudinal symmetry axis of the generally tapered cylindrical base layer 5*a* forming arrays of columns. Or, in other embodiments, they may be equally spaced from one another, or arranged in a completely random pattern.

Figure 2:
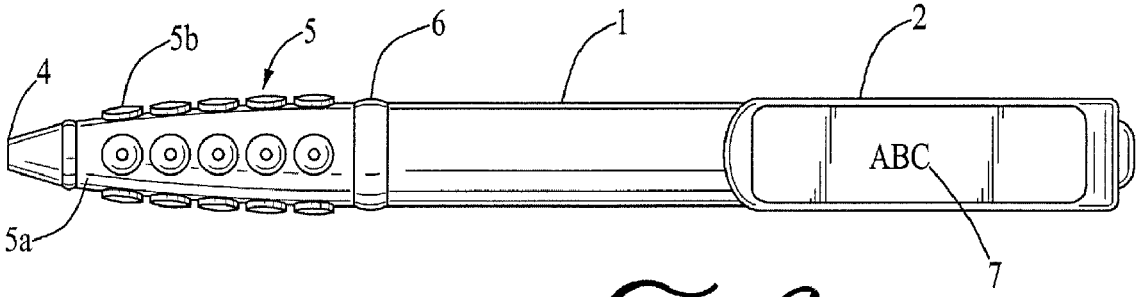
FIG. 2 is a top plan view of the preferred embodiment of the present invention showing the grip of the present invention incorporated into a handheld writing implement.
Figure 3:
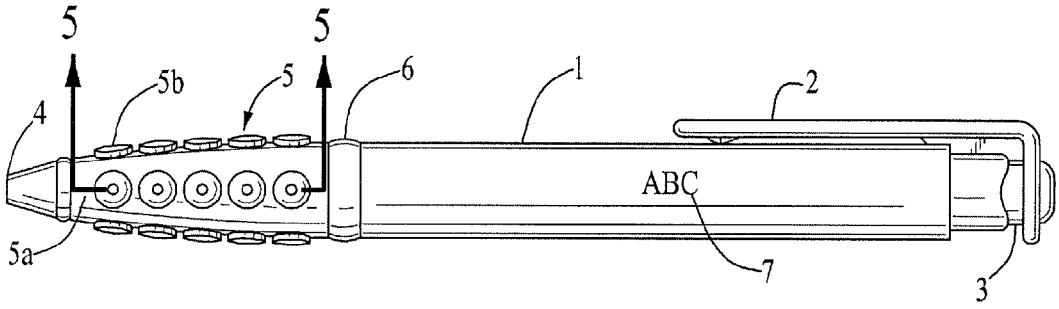
FIG. 3 is a side elevation view of the preferred embodiment of this invention showing the grip of the present invention incorporated into a handheld writing implement.
Figure 4:
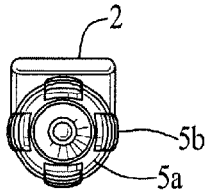
FIG. 4 is a front elevation view of the preferred embodiment of this invention showing the grip of the present invention incorporated into a handheld writing implement.

The present invention also contemplates using the handheld writing implement with the grip described above as a vehicle for effective advertisement and a method for doing that. Referring also to FIGS. 1-3, advertising material 7 such as marks, letters, symbols, pictures, or indicia may be imprinted for advertising upon any outer surface of the handheld writing implement. In one embodiment, the advertising material 7 may be imprinted on the grip 5 as shown in FIG. 1. In another embodiment, as shown in FIG. 2, the clip 2 may comprise a flat base plate upon which the advertising material may be imprinted. In still another embodiment, the advertising material 7 may be imprinted directly upon an outer surface of the body 1 of the writing implement as shown in FIG. 3.

In the figures and specification, there have been disclosed preferred embodiments of the invention. While specific terms are employed, they are used in a generic and descriptive sense only, and not for the purpose of limiting the scope of the invention. The present invention may be embodied in other specific forms without departing from the essential spirit or attributes thereof. It is desired that the embodiments described herein be considered in all respects as illustrative, not restrictive, and that reference be made to the appended claims for determining the scope of the invention.

What is claimed is:

1. A handheld writing implement comprising:

a) an elongated cylindrical implement body having a first body end and an opposing second body end, said implement body having a generally tapered cylindrical section adjacent the second body end;

b) an extendable pen tip at the second body end; and c) a grip comprising:

1) a base layer sized and configured to be retained over said generally tapered cylindrical section and 2) a plurality of rings superimposed upon an outer surface of said base layer, each of said plurality of rings having a generally round elevated circumference and a central depression to create suction effects for enhancing attachment thereto.

2. The handheld writing implement of claim 1, wherein said base layer is fabricated of cushioned compressible material.

3. The handheld writing implement of claim 2, wherein said base layer is fabricated of elastomeric material.

4. The handheld writing implement of claim 2, wherein said base layer is frictionally retained over said generally tapered cylindrical section.

5. The handheld writing implement of claim 1, further comprising a clip attached to the first body end.

6. The handheld writing implement of claim 5, wherein said clip comprises a generally flat base plate.

7. The handheld writing implement of claim 6, further comprising advertising material imprinted on said flat base plate of said clip.

8. The handheld writing implement of claim 1, further comprising advertising material imprinted upon at least one outer surface thereof for advertising.

9. The handheld writing implement of claim 1, wherein said plurality of rings arc arranged concentrically about a longitudinal symmetry axis of said base layer.

10. The handheld writing implement of claim 1, wherein said plurality of rings are arranged in a random pattern.

11. The handheld writing implement of claim 1, wherein said plurality of rings are generally equally spaced from one another.

12. The handheld writing implement of claim 1, wherein said extendable pen tip is a ball point pen tip.

13. The handheld writing implement of claim 1, wherein said grip is detachable from said implement body for replacement.

14. The handheld writing implement of claim 1, wherein said plurality of rings are integrally formed with said base layer.

15. A method of advertising comprising the steps of:

a) providing a handheld writing implement comprising:

an elongated cylindrical implement body having a first body end and an opposing second body end, the implement body having a generally tapered cylindrical section adjacent the second body end, a clip attached to the first body end, the clip comprising a generally flat base plate, an extendable pen tip at the second body end, and a grip comprising:

a base layer sized and configured to be retained over the generally tapered cylindrical section, the base layer being textured so as to provide an interesting and attractive texture when gripping the grip, and a plurality of rings superimposed upon the textured base layer, each of the plurality of rings having a generally round elevated circumference and a central depression to create suction effects for enhancing attachment thereto; and b) imprinting advertising material upon at least one outer surface of the handheld writing implement.

* * * * *